US009474318B2

(12) United States Patent
Wesson et al.

(10) Patent No.: US 9,474,318 B2
(45) Date of Patent: Oct. 25, 2016

(54) PROTECTIVE SNOW AND SKI HELMET

(71) Applicant: Bell Sports, Inc., Scotts Valley, CA (US)

(72) Inventors: Robert Wesson, Scotts Valley, CA (US); Samuel Kass, Scotts Valley, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 742 days.

(21) Appl. No.: 13/835,536

(22) Filed: Mar. 15, 2013

(65) Prior Publication Data

US 2013/0276214 A1 Oct. 24, 2013

Related U.S. Application Data

(60) Provisional application No. 61/637,798, filed on Apr. 24, 2012, provisional application No. 61/731,352, filed on Nov. 29, 2012.

(51) Int. Cl.
*A42B 3/12* (2006.01)

(52) U.S. Cl.
CPC ..... *A42B 3/125* (2013.01); *A42B 3/128* (2013.01)

(58) Field of Classification Search
CPC ..... A42B 3/063; A42B 3/064; A42B 3/065; A42B 3/125; A42B 3/128
USPC ..... 2/412
See application file for complete search history.

(56) References Cited

U.S. PATENT DOCUMENTS 5,713,082 A * 2/1998 Bassette ..... A42B 3/061 2/412
5,940,889 A * 8/1999 Shirai ..... A42B 3/283 2/171.3
8,640,267 B1 * 2/2014 Cohen ..... A42B 3/063 2/411
8,689,365 B2 * 4/2014 Cleva ..... A42B 1/08 2/412
8,726,424 B2 * 5/2014 Thomas ..... A42B 3/124 2/414
8,887,312 B2 * 11/2014 Bhatnagar ..... A42B 3/063 2/2.5
8,927,088 B2 * 1/2015 Faden ..... A41D 31/005 2/411
2006/0059605 A1 3/2006 Ferrara
2006/0059606 A1 * 3/2006 Ferrara ..... A01N 25/18 2/412
2009/0265839 A1 * 10/2009 Young ..... A42B 3/121 2/413
2014/0007322 A1 * 1/2014 Marz ..... A42B 3/065 2/411

FOREIGN PATENT DOCUMENTS

EP 0052067 A1 5/1982

OTHER PUBLICATIONS

Easton Stealth S9 Hockey and Helmet Review. Video [online]. Hockeyusdotcom. Dec. 23, 2008 [retrieved on May 19, 2013]. Retreived from Internet <URL: http://www.youtube.com/watch?v=aLCbDPm4_FY>.

* cited by examiner

*Primary Examiner* — Danny Worrell
(74) *Attorney, Agent, or Firm* — Booth Udall Fuller, PLC

(57) ABSTRACT

An alpine helmet for protecting the head of a wearer while the helmet is worn over a broad temperature range includes an outer shell and an energy dissipating internal padding assembly coupled to the outer shell. The padding assembly includes a first pad layer disposed inwardly of a second pad layer which may be adjacent an inner surface of the helmet shell. The first pad layer includes an arrangement of structural alterations that affect the performance of the first layer.

20 Claims, 5 Drawing Sheets

PROTECTIVE SNOW AND SKI HELMET

CROSS-REFERENCE TO RELATED APPLICATIONS

This application claims the benefit of and priority to U.S. Provisional Application No. 61/637,798, filed Apr. 24, 2012, and U.S. Provisional Application No. 61/731,352, filed Nov. 29, 2012. The entire contents of each above-identified application are hereby incorporated by reference herein.

TECHNICAL FIELD

The invention relates to a protective snow and ski helmet, and more particularly to a protective snow and ski helmet having a unique padding system that functions to dissipate impact energy over a broad range of temperatures experienced during use of the helmet.

BACKGROUND OF THE INVENTION

A physical impact to the head of a person may cause serious injury or death. To reduce the probability of such consequences, protective gear, such as a helmet, is often used in activities that are associated with an increased level of risk for a head injury. Examples of such activities include, but are not limited to skiing, snowboarding, sledding, ice skating, bicycling, rollerblading, rock climbing, skate boarding, and motorcycling. In general, a helmet is designed to maintain its structural integrity and stay secured to the head of a wearer during an impact.

Accordingly, a skiing or snowboarding helmet, referred to generally herein as an "alpine helmet" is designed to protect the wearer's head, including to absorb and dissipate energy during an impact with a surface, such as the ground. In this regard, alpine helmet interiors include impact attenuating materials such as an arrangement of padding and/or foam, wherein the impact attenuating materials cover and contact a significant extent of the wearer's head.

Designing an alpine helmet presents unique challenges because of the relatively wide range of temperatures to which the impact attenuating materials are exposed and within which the impact attenuating materials must remain effective. Skiing and snowboarding activities generally take place in relatively cold ambient temperatures. Indeed, it is not uncommon for skiers and snowboarders to experience temperatures or wind chills exceeding −25° C. Thus, an alpine helmet should effectively protect the wearer when the helmet is quite cold, for example after a break in activity when the helmet is taken off and left outside. Of course, the helmet should also effectively protect the wearer when the helmet is relatively warm, either because of warmer ambient conditions or because heat transfer from the wearer's head has warmed the helmet materials after the helmet has been worn for a period of time.

Most impact attenuating materials used for alpine and other types of helmets generally get harder as the temperature of the material is reduced. Such materials also generally get softer as the temperature of the material increases. These common material properties present a challenge for the designer seeking to develop an alpine helmet that provides consistent protection and energy attenuation over a wide range of temperatures. What is needed is a protective alpine helmet that maintains its protective properties throughout a wide range of ambient temperatures.

The present invention is provided to solve these limitations and to provide advantages and aspects not provided by conventional alpine helmets. A full discussion of the features and advantages of the present invention is deferred to the following detailed description, which proceeds with reference to the accompanying drawings.

SUMMARY OF THE INVENTION

The present invention is directed to a protective helmet that includes a number of improvements intended to increase the temperature range within which the helmet remains effective for protecting the wearer's head. Therefore, in some aspects, an alpine helmet for protecting the head of a wearer includes an outer shell and an energy dissipating internal padding assembly coupled to the outer shell. The padding assembly includes a first pad layer disposed inwardly of a second pad layer which may be adjacent an inner surface of the helmet shell. The first pad layer includes an arrangement of structural alterations that affect the performance of the first layer.

In some aspects, an alpine helmet for protecting the head of a wearer while the helmet is worn over a broad temperature range is provided and includes an outer shell and an energy dissipating padding assembly coupled to an interior of the outer shell. The padding assembly includes a first layer disposed inwardly of a second layer. The first layer includes structural alterations that structurally weaken the first layer.

The first layer and the second layer may be formed of the same material. The first layer may include a thickness and the structural alterations may include through holes extending through the thickness of the first layer. The first layer and the second layer may be integrally formed. The structural alterations may extend only through the first layer, and the second layer may be substantially continuous. The padding assembly may include a front pad assembly, a rear pad assembly, and a top pad assembly. The front pad assembly, the rear pad assembly, and the top pad assembly may be formed separately from one another, and each of the front pad assembly, the rear pad assembly, and the top pad assembly may include a first portion that at least partially defines the first layer and a second portion that at least partially defines the second layer. The front pad assembly may include a third layer positioned between the second layer and the outer shell. The first layer may be formed of a first layer material and the third layer may be formed of a third layer material having a density that may be greater than a density of the first layer material. The first layer and the second layer may be both formed of the first layer material. The first portions of the rear pad assembly and the top pad assembly may be formed of vinyl nitrile having a density of 0.095-0.12 g/cm$^3$, and the second portions of the rear pad assembly and the top pad assembly may be formed of vinyl nitrile having a density of 0.095-0.12 g/cm$^3$ or 0.12-0.14 g/cm$^3$. The first and second portions of the front pad assembly may be formed of vinyl nitrile having a density of 0.12-0.14 g/cm$^3$. Each of the first and second portions of the rear pad assembly and the top pad assembly may include a thickness of about 10 mm, the first portion of the front pad assembly may include a thickness of about 10 mm, and the second portion of the front pad assembly may include a thickness of about 6 mm. The front pad assembly may include a third layer positioned between the second layer and the outer shell, and the third layer may be formed of vinyl nitrile having a density of 0.16-0.22 g/cm$^3$. The first portion of the rear pad assembly and the top pad assembly may be formed of a first material having a first density, the first and second portions of the front pad assembly may be formed of a second material having a second density greater than the first density, and the front pad assembly may include a third portion extending between the second portion and the outer shell and having a third density greater than the second density. The first and second portions of the rear pad assembly may each have a first thickness such that the rear pad assembly may have an overall thickness substantially equal to twice the first thickness, and a sum of the thicknesses of the first portion, the second portion, and the third portion of the front pad may be substantially equal to the overall thickness of the rear pad assembly and the top pad assembly. The alpine helmet may also include a goggle retainer coupled to a rear portion of the outer shell.

In other aspects, an alpine helmet for protecting the head of a wearer while the helmet is worn over a broad temperature range is provided and includes an outer shell, a goggle retainer coupled to a rear portion of the outer shell, and an energy dissipating padding assembly coupled to an interior of the outer shell. The padding assembly includes a front pad assembly including a front portion and a pair of opposed side portions. The front portion includes a front portion first layer disposed inwardly of a front pad second layer. The opposed side portions each include a side portion first layer disposed inwardly of a side portion second layer. The padding assembly also includes a rear pad assembly including a rear pad first layer disposed inwardly of a rear pad second layer, and a top pad assembly including a top pad first layer disposed inwardly of a top pad second layer. The front pad assembly, the rear pad assembly, and the top pad assembly are formed separately from one another, and each of the side portion first layers, the rear pad first layer, and the top pad first layer is structurally weakened by a plurality of apertures.

The plurality of apertures may include through holes. The front portion second layer may be integral with each of the side portion second layers, and a pair of grooves may be defined between the front portion first layer and the side portion second layers. Each of the front pad assembly, the rear pad assembly, and the top pad assembly may be formed of vinyl nitrile.

While it is desirable that a protective alpine helmet prevents injuries from occurring, it should be noted that due to the nature of recreational or competitive skiing, snowboarding, and other alpine activities, no helmet, including the helmet of the present invention, can completely prevent injuries to the wearer. It should be further noted that no protective equipment can completely prevent injuries to a skier, snowboarder, or participant in other winter or alpine activities, particularly when such equipment is improperly used, or when the wearer engages in reckless or dangerous conduct. When properly worn, the helmet of the present invention is believed to offer some protection from head injury to skiers, snowboarders, or participants in other winter or alpine activities, but it is believed that no helmet can, or will ever, totally and completely prevent such injuries.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

Figure 1:
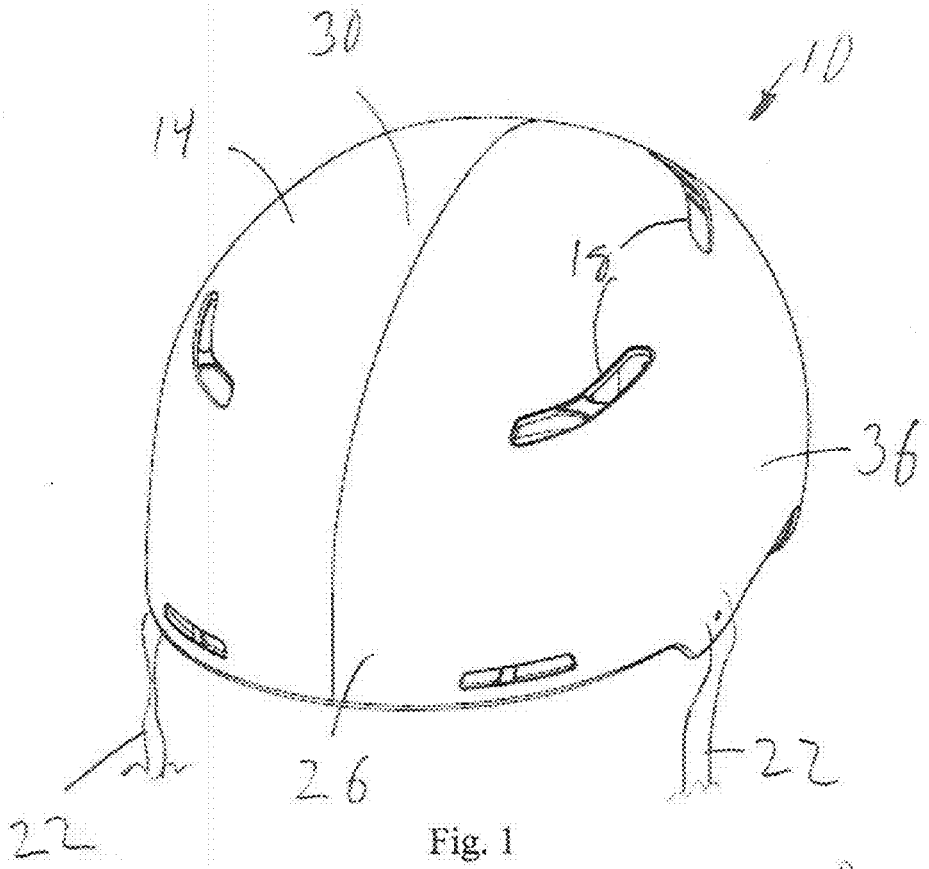
FIG. 1 is a perspective view of an embodiment of an inventive alpine helmet.

While the invention will be described in connection with the preferred embodiments shown herein, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
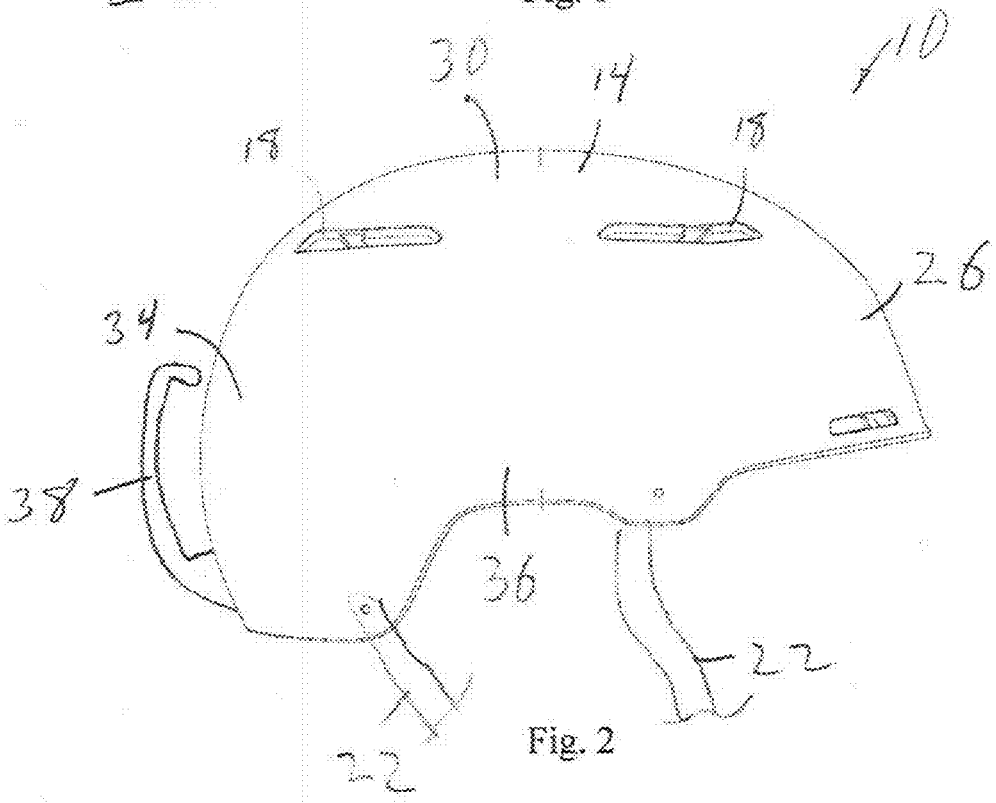
FIG. 2 is a right side view of the helmet of FIG. 1.
Figure 3:
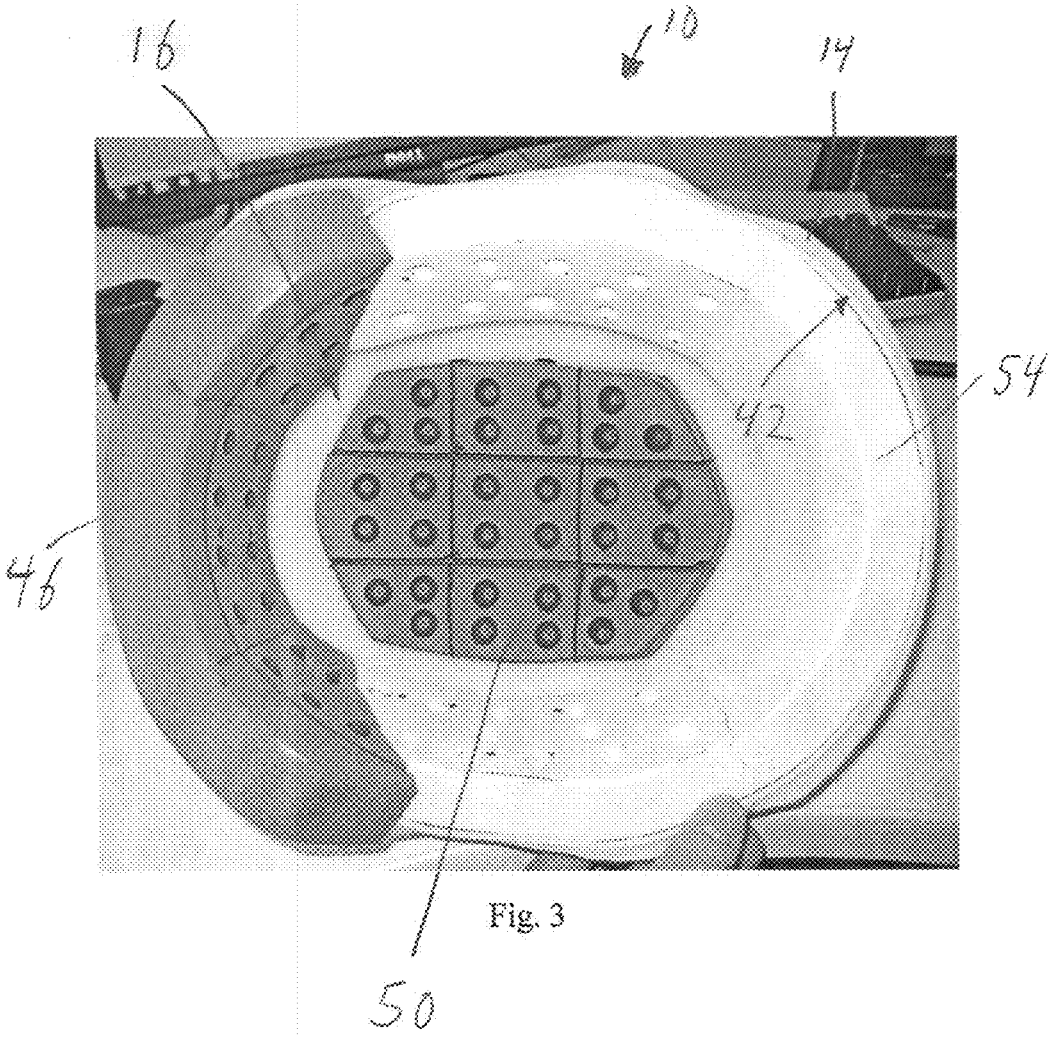
FIG. 3 is a bottom view of the helmet of FIG. 1 showing an internal padding assembly.
Figure 6:
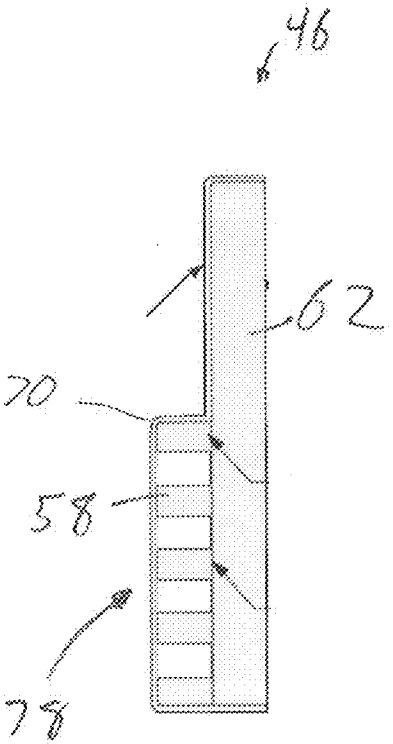
FIG. 6 is a section view taken along line 6-6 of FIG. 4.
Figure 4:
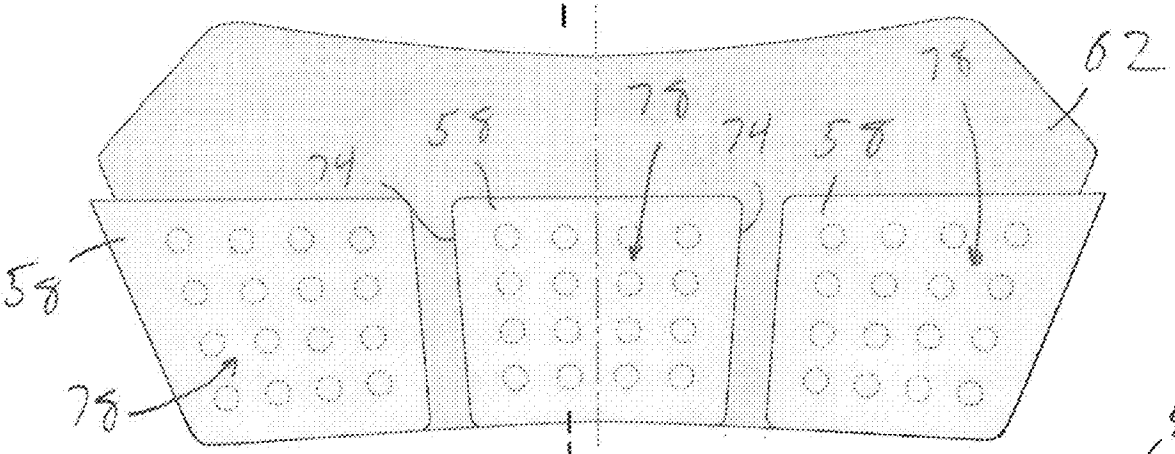
FIG. 4 is a plan view of a rear pad assembly of the internal padding assembly of FIG. 3.
Figure 5:
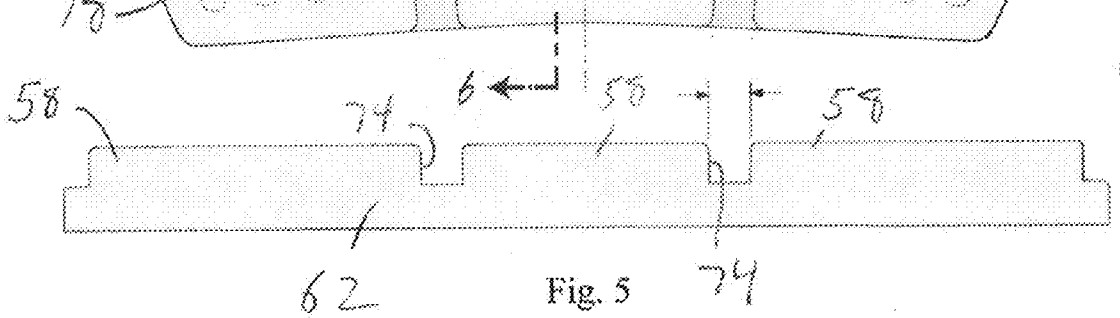
FIG. 5 is an end view of the rear pad assembly of FIG. 4.
Figure 7:
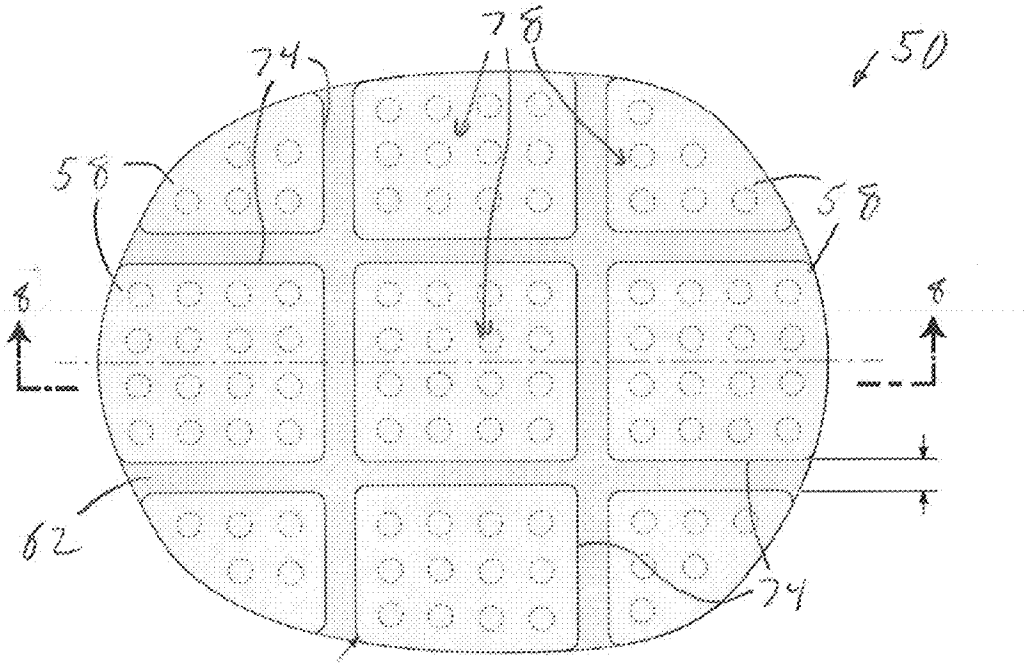
FIG. 7 is a plan view of a top pad assembly of the internal padding assembly of FIG. 3.
Figure 8:
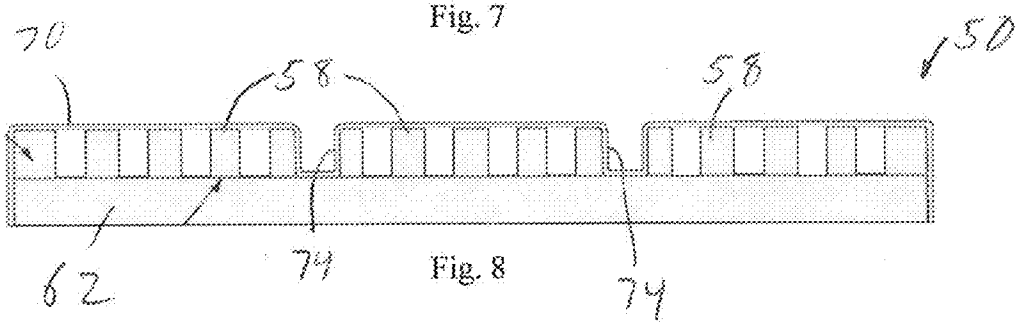
FIG. 8 is a section view taken along line 8-8 of FIG. 7.

In the Figures, and referring initially to FIGS. 1-3, an embodiment of a helmet 10 in accordance with the present invention is shown and includes a relatively hard, impact-resistant outer shell 14, an internal padding assembly 16, a plurality of ventilation openings 18 extending through the outer shell 14, and a chinstrap assembly 22 for securing the helmet 10 to the wearer's head. In some embodiments the outer shell 14 comprises a hard plastic material, such as polycarbonate, having a thickness between about 2 mm to about 2.5 mm; however, in other embodiments, the outer shell 14 may also or alternatively comprise KEVLAR, ABS plastic, carbon fiber, fiberglass, and the like, and may have increased or reduced thickness, depending at least in part upon the specific materials selected. The chinstrap assembly 22 includes connectable segments attached to the outer shell 14 for securing the helmet 10 to the wearer's head, as generally known in the art. The helmet 10 includes a frontal portion 26 that overlies the wearer's forehead, a top or crown portion 30 that overlies the crown region of the wearer's head, a rear portion 34 that overlies at least the wearer's occipital region, and side portions 36 extending along the sides and temple regions of the wearer's head. A goggle strap retainer 38 is coupled to outer shell 14 at the rear portion 34 of the helmet 10 for securing a pair of ski goggles to the helmet 10.

As shown in FIG. 3, the internal padding assembly 16 is positioned substantially adjacent an inner surface 42 of the outer shell 14 and includes a rear pad assembly 46 extending generally along the rear portion 34 of the helmet 10, a top pad assembly 50 extending generally along the top portion 30 of the helmet 10, and front pad assembly 54 extending generally along the frontal portion 26 and the side portions 36 of the helmet 10. In some embodiments, the padding assembly 16, including the rear pad assembly 46, the top pad assembly 50, and the front pad assembly 54 comprise vinyl nitrile; however, in other embodiments, the padding assembly 18 may also or alternatively comprise expanded polypropylene ("EPP") or other energy management or energy absorbing materials.

Referring also to FIGS. 4-10, each of the rear pad assembly 46 and the top pad assembly 50 includes a first or inner layer 58 that is disposed adjacent the wearer's head when the helmet 10 is worn, and a second or outer layer 62 that is positioned against the inner surface 42 of the outer shell 14. The front pad assembly 54 also includes the inner layer 58 and the outer layer 62, and further includes a third or supplemental outer layer 66 positioned between the outer layer 62 and the inner surface 42 of the outer shell 14, for reasons discussed further below. In the illustrated embodiments, each of the rear pad assembly 46, the top pad assembly 50, and the front pad assembly 54 includes an optional comfort layer 70 (FIG. 6) that covers the inner layer 58 and any exposed portions of the outer layer 62 and that directly contact the wearer's head when the helmet 10 is worn. The comfort layer 70 can be formed of a breathable, high elasticity, low friction comfort material, such as lycra, and may be secured or coupled to the rear, top, or front pad assembly 46, 50, 54 during manufacturing of the respective pad assembly. In other constructions, a one-piece, substantially hat-shaped comfort liner may be provided and may be configured to fit inside the finished helmet. Such a one-piece comfort liner may be secured to the internal padding assembly 16 and/or the outer shell 14 via straps, snaps, buttons, hook and loop fastener, and the like.

In each of the rear pad assembly 46, top pad assembly 50, and front pad assembly 54, the inner layer 58 is segmented into portions by transverse channels 74 that extend through the inner layer 58. In the illustrated embodiments, the channels 74 extend all the way though the inner layer 58. In other embodiments, the channels 74 or portions of the channels may extend only partially through the inner layer 58 and/or may extend completely or partially through the outer layer 62. The channels 74 facilitate conformity of the internal padding assembly 16 with the curved inner helmet surface 42 of the helmet 10. The rear pad assembly 46 and the front pad assembly 54 each include two substantially vertically extending channels 74 that segment the inner layer 58 into three portions. The top pad assembly 50, which is configured to conform to a more curved portion of the inner surface 42, includes four intersecting channels 74 that segment the inner layer 58 into nine portions.

In general, the material that forms the inner layers 58 and the outer layers 62 (including the supplemental outer layer 66 of the front pad assembly 54), such as the vinyl nitrile mentioned above, becomes harder and denser as its temperature decreases. When the material becomes too hard and dense, its energy absorption and impact attenuation properties can be compromised. On the other hand, as the temperature of the material increases, it generally becomes softer and less dense, including a point at which the material becomes so soft that, again, its energy absorption and impact attenuation properties can be compromised. Given these material characteristics, the design of an alpine helmet, such as the helmet 10, presents a unique challenge because it must be able to provide energy attenuation and protection over a relatively wide range of temperatures. For example, when the helmet 10 is left outside and unworn for an extended period of time on a cold winter day, the temperature of the internal padding assembly 16 can drop to a relatively low temperature (e.g. −25° C.). However, when the wearer puts the helmet on, body heat from the wearer's head begins to warm the internal padding assembly 16, especially the inner layers 58, to temperatures approaching or exceeding human body temperature. Because accidents and falls are inherently unpredictable, the wearer requires continuous protection from the moment the helmet 10 is put on through several hours of use until the helmet 10 is taken off. As such, the padding assembly 16 must be capable of effectively absorbing energy and attenuating impacts over a wide range of temperatures.

The padding assembly 16 is configured such that, in each of the rear pad assembly 46, top pad assembly 50, and front pad assembly 54, the structure of at least some portions of the inner layer 58 is altered to change certain physical properties of the inner layer 58. More specifically, the structure of the inner layer 58 is altered to improve the energy absorption and impact attenuation properties of the inner layer 58 at relatively cold temperatures. In some embodiments, the structure of the inner layer 58 is structurally altered by removing material from the inner layer 58. For example, in the illustrated embodiment, the structural alteration takes the form of an array of holes 78 that extends through the inner layer 58. The depth, size, and spacing of the holes in the array 78 may be selected and optimized to balance performance of the helmet 10 throughout the range of temperatures the helmet 10 typically experiences while being worn during alpine activities. In this regard, the holes may be or include through holes, blind holes, round holes, non-round holes, slots, grooves, notches, or substantially any other form of an opening or aperture.

The structural alteration, such as the exemplary array of holes 78, locally reduces the density of the inner layer 58 such that the inner layer 58 behaves as though it were formed of a softer, less dense material. The structural alternation also increases the heat transfer characteristics of the inner layer 58, such that the inner layer 58 increases in temperature more quickly after the helmet 10 is worn by the wearer for an appreciable period of time. In this regard the alteration modifies the inner layer 58 generally to provide more consistent performance of the pad assembly over a wide range of temperatures.

With reference to FIGS. 4 through 8, in some embodiments the rear pad assembly 46 and top pad assembly 50 may each include an inner layer 58 and an outer layer 62 formed of vinyl nitrile having a density of 0.095-0.12 g/cm$^3$, and a thickness of about 10 mm. One example of a suitable vinyl nitrile product having the desired characteristics is "Cell-Flex VN 600" available from Der-Tex Corporation ("Der-Tex") of Saco, Me. In other embodiments, the rear pad assembly 46 and top pad assembly 50 may each include an inner layer 58 formed of vinyl nitrile having a density of 0.12-0.14 g/cm$^3$, such as "Cell-Flex VN 740" available from Der-Tex, and a thickness of about 10 mm, and an outer layer 62 formed of vinyl nitrile having a density of 0.095-0.12 g/cm$^3$ and a thickness of 10 mm. In still other embodiments, one or both of the inner layer 58 and the outer layer 62 of the rear pad assembly 46 and the top pad assembly 50 may be formed of a different vinyl nitrile material having a different density and/or thickness. Each portion of the inner layer 58 includes the array of holes 78, distributed as shown, and the holes each have a diameter of about 6 mm. In the rear pad assembly 46 the two channels 74 each have a width of about 10 mm. In the top pad assembly 50, the four channels 74 each have a width of about 7 mm.

Figure 9:
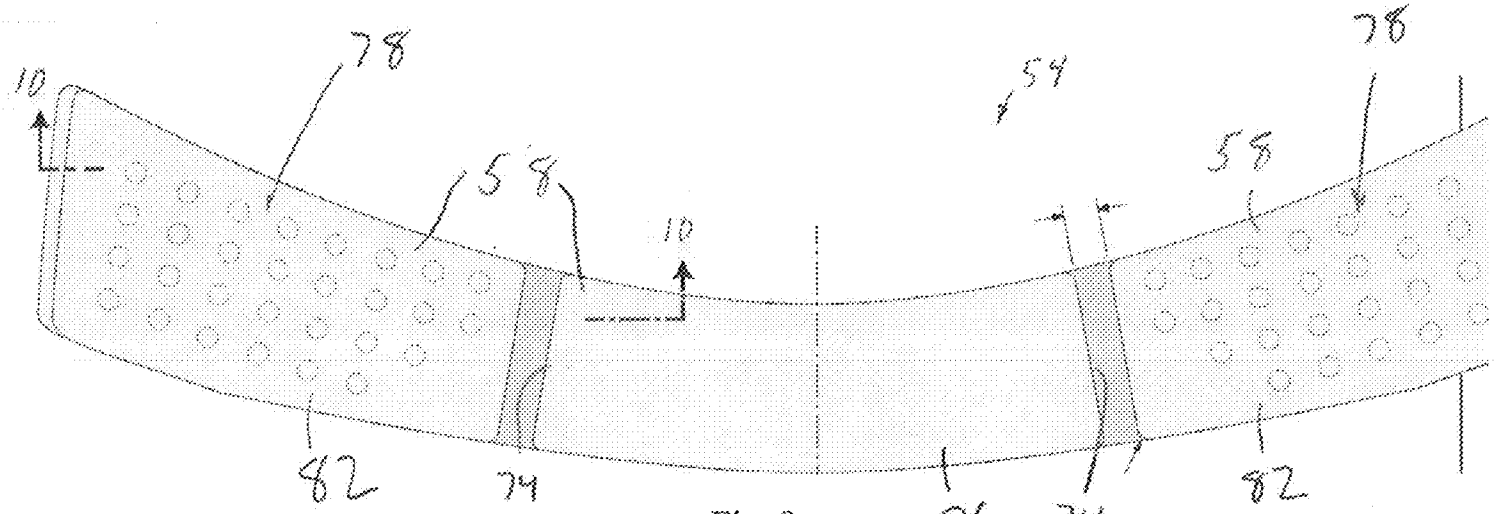
FIG. 9 is a plan view of a front pad assembly of the internal padding assembly of FIG. 3.
Figure 10:
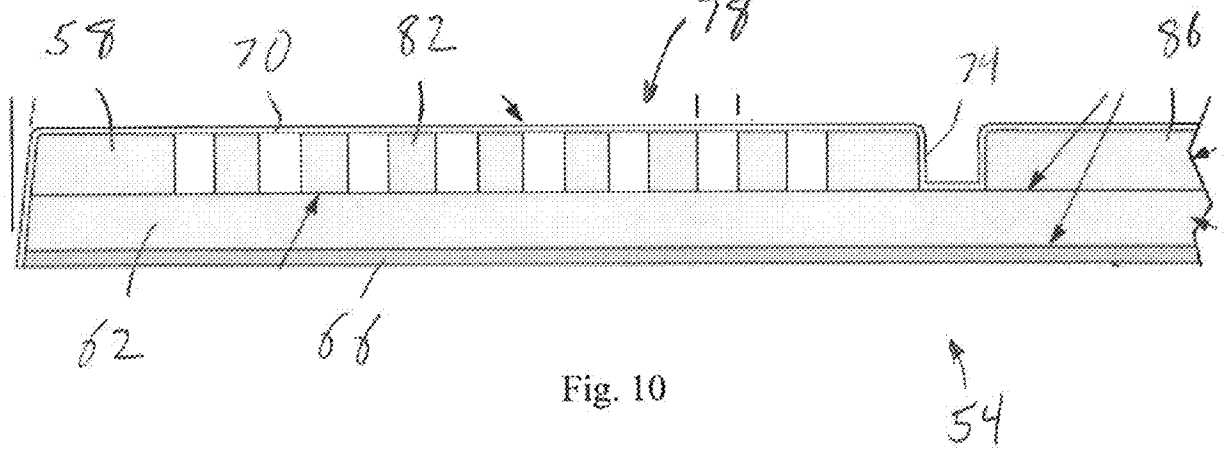
FIG. 10 is a section view taken along line 10-10 of FIG. 9.

With reference to FIGS. 9 and 10, in some embodiments the inner layer 58 of the front pad assembly 54 is divided into three portions by two channels 74, with each channel having a width of about 10 mm. The three portions of the front pad assembly 54 include two opposed side portions 82 and a front portion 86. As shown, only the inner layers 58 of the side portions 82 are provided with the array of holes 78. The inner layer 58 of the front portion 86, which is generally positioned over the wearer's forehead when the helmet 10 is worn, does not include an array of holes. In one exemplary embodiment, the side portions 82 of the front pad assembly 54 include an inner layer 58 formed of vinyl nitrile having a density of 0.095-0.12 g/cm$^3$ and a thickness of about 10 mm, and an outer layer 62 formed of vinyl nitrile having a density of 0.12-0.14 g/cm$^3$ and a thickness of about 6 mm. The front portion 86 of the front pad assembly 54 may include an inner layer 58 and an outer layer 62 formed of vinyl nitrile having a density of 0.12-0.14 g/cm$^3$, where the inner layer 58 has a thickness of about 10 mm and the outer layer 62 has a thickness of about 6 mm.

In another exemplary embodiment, the side portions 82 of the front pad assembly 54 include an inner layer 58 and an outer layer 62 formed of vinyl nitrile having a density of 0.12-0.14 g/cm$^3$, where the inner layer 58 has a thickness of about 10 mm and the outer layer 62 has a thickness of about 6 mm. The front portion 86 of the front pad assembly 54 includes an inner layer 58 having a density of 0.16-0.22 g/cm$^3$, such as "Cell-Flex VN 1000" available from Der-Tex, and a thickness of about 10 mm. In some embodiments, the front portion 86 of the front pad assembly 54 may comprise two or more sub layers formed of different combinations and thicknesses of the vinyl nitrile materials discussed above.

In some embodiments, including the above-described exemplary embodiments, the front pad assembly 54 includes the supplemental outer layer 66, which may be formed of vinyl nitrile having a density of 0.16-0.22 g/cm$^3$ and a thickness of about 4 mm. When this exemplary supplemental outer layer 66 is combined with the exemplary front pad assembly 54 configurations discussed above, even though the front pad assembly 54 includes three layers, its total thickness is approximately the same as the total thickness of the rear pad assembly 46 and the top pad assembly 50.

Because the front portion 26 of the helmet 10 is significantly curved, it tends to distribute impact forces differently than flatter portions of the helmet. As a result, it may be desirable to exclude the array of holes 78 from the inner layer 58 of the front portion 86 of the front pad assembly 54, as shown in the illustrated embodiment. The inner layer 58 of the front portion 86 may also be formed of a higher density material than the materials used for the inner layer 58 of the side portions 82 of the helmet 10.

In the illustrated embodiment, the channels 74 and the arrays of holes 78 are formed by die-cutting sheets of vinyl nitrile, which become the inner layers 58, and then gluing or otherwise attaching the die-cut sheets to similarly die cut sheets that become the outer layers 62. In other embodiments, the arrays of holes 78 can be formed by drilling blind holes to the desired depth into a sheet of material having the desired total thickness of the associated pad assembly. In such embodiments the inner layers 58 and outer layers 62 may be integrally formed.

In the illustrated embodiment, the padding assembly 16 is formed of vinyl nitrile. Compared to traditional snow-helmet padding materials, such as expanded polystyrene (EPS) and the like, vinyl nitrile is relatively flexible and conforming. When combined with a shell, such as the shell 14, formed of a suitable material and having a suitable thickness, the padding assembly 16 allows the shell 14 and thus the entire helmet 10 to bend or flex to conform to the unique contours of the wearer's head. By way of example only, the shell 14 of the illustrated embodiment is formed of ABS and has a nominal thickness of about 2 mm. In general, the shell 14 can flex in the fore/aft direction to increase or decrease the distance between the rear pad assembly 46 and the portion of the front pad assembly 54 that extends along the frontal portion 26 of the helmet 10. The shell 14 can also flex in the lateral direction to increase or decrease the distance between the opposed portions of the front pad assembly 54 that extend generally along the opposed side portions 36 of the helmet 10. The configuration of the illustrated shell 14, which is generally uniform, smoothly curved, and lacks ribs, grooves, and other dramatic cross-sectional changes, also contributes to the overall flexibility of the helmet 10. Flexibility of the helmet 10 can improve the fit of the helmet 10, which can enhance protection. Flexibility of the helmet 10 also can improve the relative comfort of the helmet.

Those skilled in the art will appreciate that by applying the foregoing teachings, helmets may be produced that are capable of complying with ASTM F2040-11, the ASTM Standard Specification for Helmets Used for Recreational Snow Sports, BS EN 1077:2007, the British Standard for Helmets for Alpine Skiers and Snowboarders, and CSA Z263.1-08, the Canadian Standards Association Standard for Recreational Alpine Skiing and Snowboarding Helmets, each of which is hereby incorporated by reference in its entirety.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An alpine helmet for protecting the head of a wearer while the helmet is worn over a broad temperature range, the helmet comprising:

an outer shell; and an energy dissipating padding assembly coupled to an interior of the outer shell, the padding assembly including a first layer disposed inwardly of a second layer, wherein:

the first layer includes structural alterations formed as holes extending through a thickness of the first layer and not the second layer to structurally weaken the first layer and leave the second layer substantially continuous, the first layer and the second layer are formed of the same material, and wherein a front portion of the energy dissipating padding assembly is formed as a pad assembly including a third layer positioned between the second layer and the outer shell.

2. The alpine helmet of claim 1, wherein the first layer and the second layer are integrally formed.

3. The alpine helmet of claim 1, wherein the padding assembly includes a front pad assembly, a rear pad assembly, and a top pad assembly, wherein the front pad assembly, the rear pad assembly, and the top pad assembly are formed separately from one another, and wherein each of the front pad assembly, the rear pad assembly, and the top pad assembly includes a first portion that at least partially defines the first layer and a second portion that at least partially defines the second layer.

4. The alpine helmet of claim 1, wherein the first layer is formed of a first layer material and wherein the third layer is formed of a third layer material having a density that is greater than a density of the first layer material.

5. The alpine helmet of claim 3, wherein the first portions of the rear pad assembly and the top pad assembly are formed of vinyl nitrile having a density of 0.095-0.12 g/cm$^3$, and wherein the second portions of the rear pad assembly and the top pad assembly are formed of vinyl nitrile having a density of 0.095-0.12 g/cm$^3$ or 0.12-0.14 g/cm$^3$.

6. The alpine helmet of claim 5, wherein the first and second portions of the front pad assembly are formed of vinyl nitrile having a density of 0.12-0.14 g/cm$^3$.

7. The alpine helmet of claim 6, wherein each of the first and second portions of the rear pad assembly and the top pad assembly include a thickness of about 10 mm, wherein the first portion of the front pad assembly includes a thickness of about 10 mm, and wherein the second portion of the front pad assembly includes a thickness of about 6 mm.

8. The alpine helmet of claim 6, wherein the third layer is formed of vinyl nitrile having a density of 0.16-0.22 g/cm$^3$.

9. The alpine helmet of claim 3, wherein the first portion of the rear pad assembly and the top pad assembly is formed having a first density, wherein the first and second portions of the front pad assembly are formed of a second density greater than the first density, and wherein the front pad assembly includes a third portion extending between the second portion and the outer shell and having a third density greater than the second density.

10. The alpine helmet of claim 9, wherein the first and second portions of the rear pad assembly each have a first thickness such that the rear pad assembly has an overall thickness substantially equal to twice the first thickness, and wherein a sum of the thicknesses of the first portion, the second portion, and the third portion of the front pad is substantially equal to the overall thickness of the rear pad assembly and the top pad assembly.

11. The alpine helmet of claim 1, further comprising a goggle retainer coupled to a rear portion of the outer shell.

12. An alpine helmet for protecting the head of a wearer while the helmet is worn over a broad temperature range, the helmet comprising:

an outer shell; and an energy dissipating padding assembly coupled to an interior of the outer shell, the padding assembly including a first layer disposed inwardly of a second layer, wherein the first layer and the second layer are integrally formed of a same material, and the padding assembly further including:

a front pad assembly including a front portion and a pair of opposed side portions, the front portion including a front portion first layer disposed inwardly of a front pad second layer, and the opposed side portions each including a side portion first layer disposed inwardly of a side portion second layer, a rear pad assembly including a rear pad first layer disposed inwardly of a rear pad second layer, and a top pad assembly including a top pad first layer disposed inwardly of a top pad second layer, wherein the front pad assembly, the rear pad assembly, and the top pad assembly are formed separately from one another, and wherein each of the side portion first layers, the rear pad first layer, and the top pad first layer is structurally weakened by a plurality of apertures.

13. The alpine helmet of claim 12, wherein the plurality of apertures include through holes extending through a thickness of the first layer and not the second layer to structurally weaken the first layer.

14. The alpine helmet of claim 12, wherein a pair of grooves are defined between the front portion first layer and the side portion second layers.

15. The alpine helmet of claim 12, wherein each of the front pad assembly, the rear pad assembly, and the top pad assembly is formed of vinyl nitrile.

16. An alpine helmet for protecting the head of a wearer while the helmet is worn over a broad temperature range, the helmet comprising:

an outer shell; and an energy dissipating padding assembly coupled to an interior of the outer shell, the padding assembly including a first layer disposed inwardly of a second layer, wherein the first layer includes structural alterations formed as holes extending through a thickness of the first layer and not the second layer to structurally weaken the first layer and leave the second layer substantially continuous.

17. The alpine helmet of claim 16, further comprising forming the energy dissipating padding assembly comprising a front portion, wherein the front portion first layer is formed without apertures through the first layer of the front portion.

18. The alpine helmet of claim 16, wherein the first layer and the second layer are integrally formed.

19. The alpine helmet of claim 16, wherein the energy dissipating padding assembly comprises a front pad assembly that includes a third layer positioned between the second layer and the outer shell.

20. The alpine helmet of claim 16, wherein the first layer and the second layer are formed of the same material.

* * * * *